US005639082A

United States Patent [19]

Pollich

[11] Patent Number: 5,639,082

[45] Date of Patent: Jun. 17, 1997

[54] DEVICE FOR ALIGNING SHEETS WITH A SUCTION PLATE

[75] Inventor: Gerhard Pollich, Heidelberg, Germany

[73] Assignee: Heidelberger Druckmaschinen AG, Heidelberg, Germany

[21] Appl. No.: 575,520

[22] Filed: Dec. 20, 1995

[30] Foreign Application Priority Data

Dec. 20, 1994 [DE] Germany ..... 44 45 443.0

[51] Int. Cl.[6] ..... B65H 9/00; B65H 9/16

[52] U.S. Cl. ..... 271/236; 271/250

[58] Field of Search ..... 271/234, 231, 271/236–240, 250, 251, 253, 254

[56] References Cited

U.S. PATENT DOCUMENTS 4,060,237 11/1977 Degen et al. ..... 271/237 X
4,693,463 9/1987 Schwebel et al. ..... 271/250 X

FOREIGN PATENT DOCUMENTS 617605 8/1935 Germany ..... 271/250
1800477 3/1972 Germany .
4125504 2/1993 Germany ..... 271/250
1172646 12/1969 United Kingdom .

*Primary Examiner*—Boris Milef
*Attorney, Agent, or Firm*—Herbert L. Lerner; Laurence A. Greenberg

[57] ABSTRACT

Device for aligning sheets in a sheet-processing machine having a rotatingly driven suction plate disposed in a transport surface and being formed with suction openings collectively forming hole patterns shaped as circular-ring sectors, the suction openings communicating intermittently, at each revolution of the suction plate, with a suction-chamber arrangement situated below the suction plate, the suction-chamber arrangement having two suction-chamber openings disposed on respective diametrics of the suction plate and offset from one another by a defined diametric angle, each of the suction-chamber openings having a radial extent matching a radial extent of the hole pattern respectively associated therewith.

10 Claims, 3 Drawing Sheets

DEVICE FOR ALIGNING SHEETS WITH A SUCTION PLATE

BACKGROUND OF THE INVENTION

Field of the Invention

The invention relates to a device for aligning sheets on a sheet-processing machine, particularly a sheet-fed printing press, wherein the sheets are fed consecutively in a main transport direction along a transport surface, a suction plate being embedded in the transport surface and disposed flush therewith, the suction plate being rotatingly drivable with respect to a rotational axis extending perpendicularly to the transport surface and being formed with suction openings communicating from time to time, during operational rotation of the suction plate and in time with the consecutive fed sheets at each revolution of the suction plate, with a suction-chamber arrangement situated below the suction plate.

A device of the general type mentioned in the introduction hereto has become known from the German Patent Publication DE-PS 617 605. This heretofore known device has rotating suction plates provided with suction openings, by means of which sheets in sheet-processing machines are moved simultaneously against front and side lays in order to obtain a defined sheet alignment permitting reproducible further processing, e.g., an in-register printing process.

SUMMARY OF THE INVENTION

It is an object of the invention to provide a device of the foregoing general type with which it is possible to determine the timing of the aligning forces achievable thereby which are exertable on a sheet in the main transport direction and in a lateral direction extending transversely thereto.

With the foregoing and other objects in view, there is provided, in accordance with the invention, a device for aligning sheets in a sheet-processing machine having a rotatingly driven suction plate disposed in a transport surface and being penetrated by suction openings collectively forming hole patterns shaped as circular-ring sections, the suction openings communicating intermittently, at each revolution of the suction plate, with a suction-chamber arrangement situated below the suction plate, the suction-chamber arrangement comprising means for forming two suction-chamber openings disposed on respective diametrics of the suction plate and offset from one another by a defined diametric angle, each of the suction-chamber openings having a radial extent matching a radial extent of the hole pattern respectively associated therewith.

In accordance with another aspect of the invention, there is provided a device for aligning sheets in a sheet-processing machine, wherein the sheets are fed consecutively in a main transport direction along a transport surface, including a suction plate embedded in the transport surface and disposed flush therewith, the suction plate being rotatingly drivable with respect to a rotational axis extending perpendicularly to the transport surface and being formed with suction openings communicating intermittently, during operational rotation of the suction plate and in time with the consecutively fed sheets at each revolution of the suction plate, with a suction-chamber arrangement situated below the suction plate, and comprising means for forming a first suction-chamber opening and a second suction-chamber opening, respectively, covered by the suction plate and extending radially with respect to the rotational axis; the first suction-chamber opening being disposed on a first diametric of the suction plate extending transversely with respect to the main transport direction, and the second suction-chamber opening being disposed on a second diametric of the suction plate, the second diametric being offset with respect to the first diametric by a diametric angle in the rotational direction of the suction plate, and the diametric angle being at most 90°; the suction-chamber openings, respectively, being operatively associated with at least one related hole pattern formed of at least one part of the suction openings; the related hole pattern having an envelope curve at least approximately in the form of a circular-ring sector concentric with respect to the rotational axis, the circular-ring sector being formed, on a first end face leading in the rotational direction of the suction plate, with a first row of holes formed by a first part of the suction openings and, on a second end face lagging in the rotational direction of the suction plate, with a second row of holes formed by a second part of the suction openings, the related hole pattern having a radial extent matching that of the suction-chamber opening operatively associated therewith.

In accordance with another feature of the invention, the second row of holes of a first one of the circular-ring sector-shaped hole patterns operatively associated with the first suction-chamber opening, and the first row of holes of a second one of the circular-ring-sector-shaped hole patterns operatively associated with the second suction-chamber opening extend substantially radially with respect to the rotational axis and enclose an angle having at least the size of the diametric angle.

In accordance with a further feature of the invention, the first suction-chamber opening and the second suction-chamber opening have substantially a like radial extent, and the first and the second suction-chamber openings are operatively associated with a common circular-ring sector-shaped hole pattern.

In accordance with an added feature of the invention, the two suction-chamber openings have respectively different radial extents, one of the two suction-chamber openings, as viewed with respect to an imaginary lateral cylindrical surface concentric with the rotational axis, being disposed radially inside the imaginary lateral cylindrical surface, and the other of the two suction-chamber openings being disposed radially outside the imaginary lateral cylindrical surface.

In accordance with an additional feature of the invention, the suction plate comprises a first and a second imaginary sector, respectively, having a selected sector angle between a first sector-angle arm leading in the rotational direction of the suction plate, and a sector-angle arm lagging in the rotational direction of the suction plate, a selected phase angle between the first sector-angle arms of the two sector angles; a first row of holes and a second row of holes of a first circular-ring sector-shaped hole pattern operatively associated with the first suction-chamber opening lying, respectively, substantially on the first and the second sector-angle arms of the first sector, and a first row of holes and a second row of holes of a second circular-ring sector-shaped hole pattern operatively associated with the second suction-chamber opening lying, respectively, substantially on the first and the second sector-angle arms of the second sector.

In accordance with yet another feature of the invention, the diametric angle has a value of 90°, and the phase angle has a value of substantially zero; the lagging second sector-angle arm of the first sector and the leading first sector-angle arm of the second sector enclosing an angle of substantially 90°, the second row of holes of the first circular-ring sector-shaped hole pattern adjoining a third related hole pattern formed of further suction openings, the third related hole pattern having an envelope curve substantially in the form of a third circular-ring sector concentric with the rotational axis and having a radial extent lying within that of the first hole pattern, the third hole pattern having an extent in the circumferential direction of the suction plate substantially like that of the second hole pattern, a further part of the suction openings forming the third hole pattern having a relative total opening cross section, relative to a defined rotational angle of the suction plate, which is smaller than a corresponding relative total opening cross section of that part of the suction openings forming the first hole pattern.

In accordance with yet a further feature of the invention, suction-chamber openings are formed on a first and on a second of two suction chambers independently connectable to a vacuum source.

In accordance with yet an added feature of the invention, the device is operatively associated with a side-pull device. In accordance with a concomitant feature of the invention, the sheet-processing machine is a sheet-fed printing press.

The device according to the invention makes it possible, with a suitable matching of the diametric angle and of the hole patterns, to exert an influence not only on at least intermittently or temporarily simultaneous aligning forces in the main transport direction and in a lateral direction extending transversely thereto but also on aligning forces acting strictly separately in time in both of the aforementioned directions. The achievable aligning movements can be additionally influenced by certain parameters. Such parameters are, for example, the shape, cross section and radial position of the two suction-chamber openings as well as the vacuum prevailing in the respective suction-chamber opening. With regard to the hole pattern, the parameters also include all geometrical data regarding the layout of the hole pattern, such as the cross sections of the suction openings, the reciprocal positions of the suction openings with respect to one another and the envelope curve or arc enclosing the hole pattern.

A device according to the invention produces an aligning force on a sheet, the underside of which is supported by the transport surface, in that a vacuum in those suction openings momentarily crossing a particular suction-chamber opening presses the sheet against the plate surface of the suction plate, the surface being flush with the transport surface. During the operational rotation of the suction plate about the rotational axis thereof perpendicular to the transport surface, the foregoing action results in an aligning force at the respective location of a respective suction-chamber opening. The line of action of a respective aligning force is perpendicular on the respective diametric on which the respective suction-chamber opening is disposed, and the direction of the aligning force extends in the rotational direction of the suction plate. Thus, an aligning force in the main transport direction is exerted upon a sheet when the hole pattern associated with the first suction-chamber opening crosses the first suction-chamber opening, because the suction-chamber opening is disposed on a diametric of the suction plate perpendicular to the main transport direction. When the hole pattern associated with the second suction-chamber opening crosses the second suction-chamber opening, the sheet is subjected to an aligning force which has a more-or-less large first and second aligning-force component, depending upon the selected value of the diametric angle, a first component being perpendicular to the aforementioned aligning force and extending in the rotational direction of the suction plate in a lateral direction transverse to the main transport direction, and a second component extending parallel to the aforementioned aligning force and extending in the rotational direction of the suction plate. The aforementioned second component, through the selection of the aforementioned diametric angle, may be designed to a value of 90°. The device according to the invention makes it possible, through the selection of the diametric angle as well as of the position of a respective hole pattern on the suction plate and the extent of a respective hole pattern in the circumferential direction of the suction plate, to determine the beginning and end of the duration of the effect of the aligning forces acting in the main transport direction and in the lateral direction.

The aligning force acting in the lateral direction may also be advantageously used in order to reinforce the action of the side-pull device in the case of a sheet-alignment device equipped with a side-pull device of conventional type. For this purpose, when employing the principle of the invention, each lateral edge region of the sheet is associated with a first and a second aforementioned suction-chamber arrangement and with a respective aforementioned suction plate, and the respective suction-chamber arrangements are, during operation, subjected to vacuum in such a manner that an aligning force in the lateral direction occurs merely in that edge region of the sheet facing that side lay which is provided with side alignment.

Overall, therefore, there is an extremely flexible alignment system of simple construction. Due to the fact that the suction plate rotates across the suction-chamber openings, the suction plate assumes control of the duration in which the respective sheet is subjected to vacuum. A suction plate equipped with a hole-pattern arrangement according to the invention acts like a switching element for the control of vacuum-produced aligning forces acting upon the sheet, with the result that it is possible to dispense with control means for the periodic actuation of valves in the vacuum lines leading to the suction chambers.

According to an embodiment of the invention, the second row of holes of a first circular-ring sector-shaped hole pattern associated with the first suction-chamber opening and the first row of holes of a second circular-ring sector-shaped hole pattern associated with the second suction-chamber opening extend more-or-less radially with respect to the rotational axis and enclose an angle having at least the size of the diametric angle. The thereby achievable timing of the aligning forces is characterized in particular in that the aligning force in the main transport direction remains in effect when the aligning force in the lateral direction starts. Consequently, a sheet which is to be aligned is subjected, throughout the entire alignment phase, to the uninterrupted action of defined aligning forces.

In a further embodiment, the first suction-chamber opening and the second suction-chamber opening are more-or-less of one and the same radial extent, and the first and the second suction-chamber openings are associated with a common circular-ring sector-shaped hole pattern. Consequently, with regard to the timing of the aligning forces, there results, for a diametric angle of 90°, an equal duration of the effect both of the aligning force in the main transport direction and of the aligning force in the lateral direction, the first-mentioned aligning force taking effect first, followed after a further rotation of the suction plate about a rotational angle approximately equivalent to the diametric angle, by the last-mentioned aligning force.

If the diametric angle is less than 90°, it is thus possible, also during the duration of the effect of the aligning force in the lateral direction, to obtain an aligning-force component in the main transport direction, produced at the second suction-chamber opening. Consequently, it is possible, in particular, to ensure that a sheet which has been aligned at front lays under the action of the aligning force in the main transport direction, produced on the first diametric, maintains its front-lay alignment during the subsequent lateral alignment by means of the aligning-force component acting in the lateral direction, produced on the second diametric. Thus, if a device having a construction according to the invention is employed, there is no need for further measures, such as subjecting the upper side of the sheet to an aligning force produced by brush rollers, in order to maintain the aligned position of the sheet against the front lays during the lateral alignment of the sheet.

In a further construction, the two suction-chamber openings are of different radial extents inasmuch as, with respect to an imaginary lateral cylindrical surface concentric with the rotation axis, one of the two suction-chamber openings is disposed radially inside the imaginary lateral cylindrical surface and the other of the two suction-chamber openings is disposed radially outside the imaginary lateral cylindrical surface. This construction is characterized, in particular, in that it is possible individually to determine, on the one hand, the duration of the effect of the aligning force in the main transport direction and, on the other hand, the duration of the effect of the aligning force or aligning force component in the lateral direction for a diametric angle of 90° or less than 90°, the foregoing being achieved by the distance the hole pattern associated with the respective suction-chamber opening extends in the circumferential direction of the suction plate.

In a further construction of the aforementioned embodiment, the suction plate comprises a first and a second imaginary sector, each with a selected sector angle between a first sector-angle arm leading in the rotational direction of the suction plate, and a second sector-angle arm lagging in the rotational direction of the suction plate, and a selected phase angle between the first sector-angle arms of the two sector angles: the first row of holes and the second row of holes of a first circular-ring sector-shaped hole pattern associated with the first suction-chamber opening lying, respectively, more-or-less on the first and second sector-angle arms of the first sector; and the first row of holes and the second row of holes of a second circular-ring sector-shaped hole pattern associated with the second suction-chamber opening lying, respectively, more-or-less on the first and second sector-angle arms of the second sector. In this case, the time sequence of the aligning forces in the main transport direction and in the lateral direction, for a defined diametric angle, is specified by the choice of the phase angle between the first sector-angle arms of each of the two sector angles.

Furthermore, the aforementioned embodiment is preferably of such construction that the diametric angle has a value of 90°, the phase angle has a value of more-or-less zero, the lagging second sector-angle arm of the first sector and the leading first sector-angle arm of the second sector enclosing an angle of more-or-less 90°, the second row of holes of the first circular-ring sector-shaped hole pattern being adjoined by a third connected or related hole pattern formed by further suction openings, the third hole pattern having an envelope curve or arc having more-or-less the form of a third circular-ring sector concentric with the rotational axis and having a radial extent lying within that of the first hole pattern and being of an extent in the circumferential direction of the suction plate more-or-less the same as that of the second hole pattern; and the further part of the suction openings forming the third hole pattern having a relative total opening cross section, relative to a defined rotational angle of the suction plate, which is smaller than a corresponding relative total opening cross section of that part of the suction openings forming the first hole pattern. Such an embodiment is characterized in particular in that, despite the absence of an aligning force component in the main transport direction at the location of the second suction-chamber opening, there remains an aligning force of reduced intensity in the main transport direction even during the duration of the effect of the aligning force in the lateral direction, produced at the second suction-chamber opening. The aligning force of reduced intensity is produced, in the case at hand, at the first suction-chamber opening through the cooperation thereof with the third hole pattern.

Moreover, both suction-chamber openings are preferably formed at a first and at a second of two suction chambers independently connectable to a vacuum source. Accordingly, in a first variant construction, the first suction-chamber opening may be in communication with a first vacuum source and the second suction-chamber opening may be in communication with a second vacuum source, it being possible for one of the two vacuum sources to be switched off, if required, for a defined operating state of the device or, alternatively, for it to deliver a vacuum of different magnitude from that of the other of the two vacuum sources.

In a second variant construction, the mutually independent connection of the two suction-chamber openings to a vacuum source may be effected by providing that a respective suction-chamber opening be connected to one and the same vacuum source through the intermediary of a respective suction line, closable, if required, by means of a valve, wherein the valve in at least one of the two suction lines is open during operation.

In an advantageous manner, the device according to the invention is associated with a side-pull device of the sheet-processing machine. The thereby achievable advantage is that the pulling action of the side-pull device is reinforced or supported by the aligning force or aligning-force component in the lateral direction, producible by means of the device. It is advisable in this respect to ensure that there is more-or-less coincidence between, on the one hand, the lines of action of the aligning force or aligning-force component in the lateral direction, produced by means of the device and, on the other hand, that aligning force produced with the side-pull device.

Other features which are considered as characteristic for the invention are set forth in the appended claims.

Although the invention is illustrated and described herein as embodied in a device for aligning sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
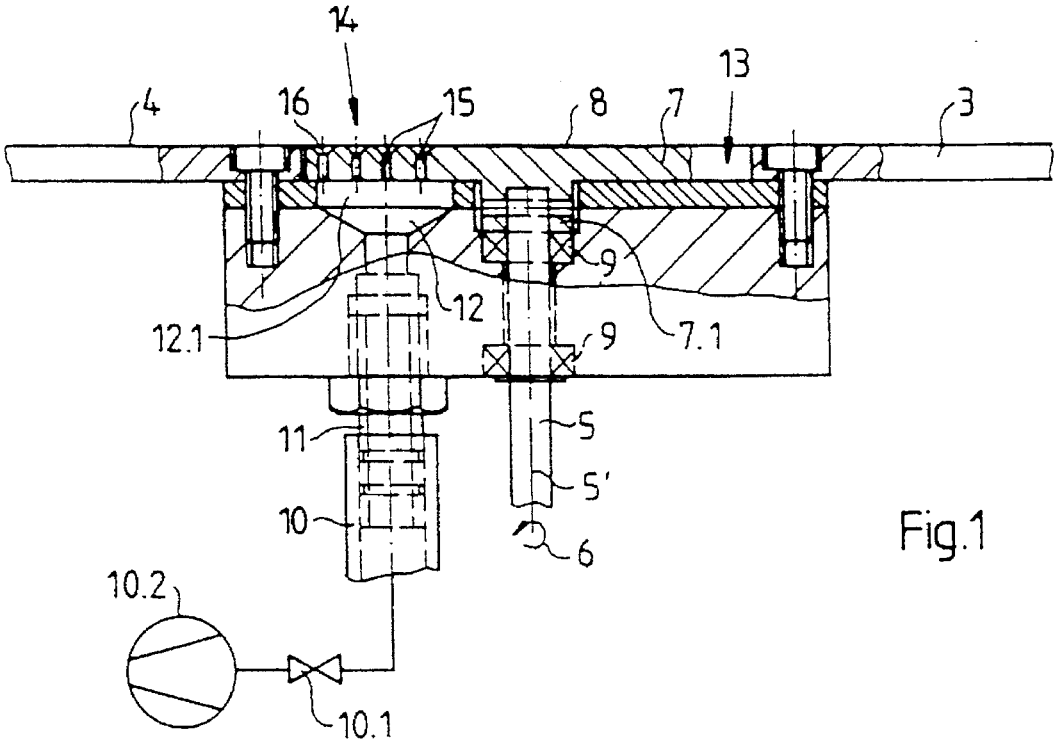
FIG. 1 is a side elevational view, partly in section, of a device for aligning sheets in accordance with the invention.
Figure 2:
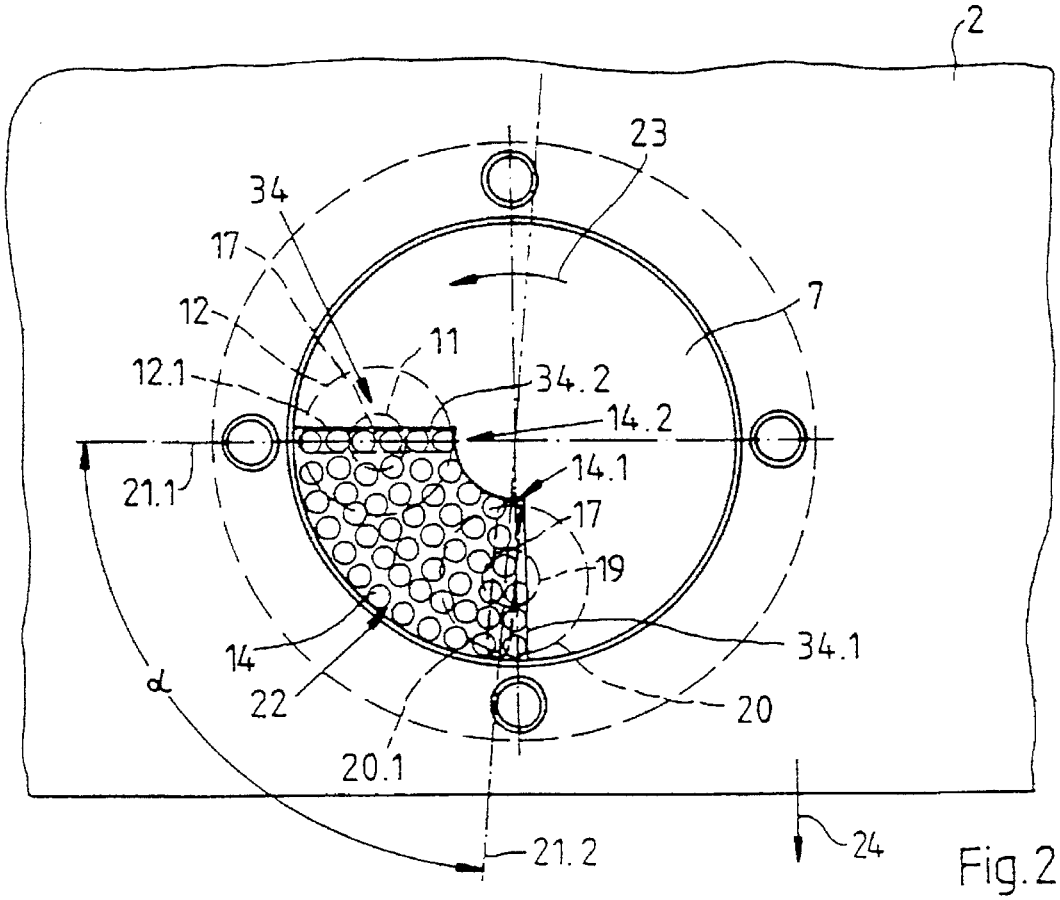
FIG. 2 is a top plan view of FIG. 1.

Referring now to the drawing and, first, particularly to FIGS. 1 and 2 thereof, there is shown therein a device for aligning sheets 2 in sheet-processing machines having a table 3, the surface of which forms a transport surface 4 on which the sheets 2 to be aligned are transported in a main transport direction represented by the arrow 24 in FIG. 2 and on which, for the purpose of defined alignment for subsequent further processing, the sheets 2 come up against non-illustrated front and side lays.

According to FIG. 1, the device includes a shaft 5, which is connected to a suction plate 7 so as to be non-rotatable relative thereto, the shaft 5 having a rotational axis 5' and being set into rotation during operation (note the arrow 6) by means of a non-illustrated drive and driving the suction plate 7, the surface 8 of the suction plate 7 being flush with the transport surface 4. The shaft 5 extends perpendicularly to the transport surface and is guided in a defined manner in bearings 9.

A suction line 10, which is connected to a vacuum source 10.2 through the intermediary of a shutoff valve 10.1, leads to a connection port or union 11, which is in communication with a first suction chamber 12. The first suction chamber 12 has a first suction-chamber opening 12.1, which terminates in a recess 13 formed in the table 3, the suction plate 7 being fitted into the recess 13 in such a manner that it covers the first suction-chamber opening 12.1. The suction plate 7 is penetrated by suction openings 14, which are in the form of bores 15 and are provided with chamfers 16 in the vicinity of the surface 8 of the suction plate 7.

As is apparent from FIG. 2, the first suction-chamber opening 12.1 is in the form of a slit which extends in the radial direction with reference to the rotation axis 5' of the suction plate 7 and which, to that extent, has the shape of an oblong hole or slot. In the embodiment of FIG. 2, the suction openings 14 are each of identical diameter, the width of the slit 17 being adapted to the diameter. The slit 17 extends approximately from the edge of the suction plate 7 to approximately as far as a hub 7.1 of the suction plate 7, the suction plate 7 being pinned to the shaft 5 through the intermediary of the hub 7.1.

As is indicated in FIG. 2, there is a further connection port or union 19 corresponding to the connection port or union 11, the further connection port 19 likewise leading to a non-illustrated vacuum source and terminating in a second suction chamber 20 corresponding to the first suction chamber 12.

The second suction chamber 20 has a second suction-chamber opening 20.1, which likewise terminates in the recess 13 formed in the table 3, is covered by the suction plate 7 and likewise extends in the form of a slit 17 in the radial direction with respect to the rotational axis 5' of the suction plate 7 from the edge of the suction plate 7 to approximately as far as the hub 7.1 thereof.

A first diametric 21.1, perpendicular to the main transport direction 24, forms a line of symmetry of the first suction-chamber opening 12.1, while a line of symmetry of the second suction-chamber opening 20.1 is formed by a second diametric 21.2 of the suction plate 7, the second diametric 21.2 being offset, as viewed in the rotational direction of the suction plate 7, by a diametric angle alpha with respect to the first diametric 21.1, the diametric angle alpha being slightly smaller than 90° in the exemplary embodiment shown in FIG. 2.

The suction openings 14 provided on the suction plate 7 are disposed to form a connected hole pattern 22 having an envelope curve which is formed basically in the shape of a circular-ring sector 34 concentric with the rotational axis 5', the circular-ring sector 34 being limited in the circumferential direction by a first end face leading in the rotational direction of the suction plate 7, and by a lagging second end face 34.2. Formed along the first end face 34.1 by a first part of the suction openings 14 is a first row of holes 14.1, and formed along the second end face 34.2 by a second part of the suction openings 14 is a second row of holes 14.2. The two rows of holes 14.1 and 14.2 are preferably disposed radially with respect to the rotational axis 5'. The respective ends of the two likewise radially extending suction-chamber openings 12.1 and 20.1 lie approximately on an inner and on an outer envelope arc, respectively, of the circular-ring sector 34. Consequently, the radial extent of the hole pattern 22 is matched to that of the two suction-chamber openings 12.1 and 20.1, the first and the second suction-chamber openings 12.1 and 20.1 having, moreover, more or less one and the same radial extent.

Upon each revolution of the suction plate 7, the hole pattern 22 inside the circular-ring sector 34 sweeps both the first suction-chamber opening 12.1 and also the second suction-chamber opening 20.1. In the embodiment of FIG. 2, each suction-chamber opening 12.1 and 20.1 is associated with a common hole pattern 22 formed, moreover, from the entirety of the suction openings 14, with the result, therefore, that each suction-chamber opening 12.1 and 20.1 is also associated with at least one hole pattern 22 formed by at least one part of the suction-chamber openings 14.

The first and the second rows of holes 14.1 and 14.2 enclose an angle which is greater than the diametric angle alpha enclosed between the two diametrics 21.1 and 21.2. Because, in the embodiment according to FIG. 2, each suction-chamber opening 12.1 and 20.1 is associated with a common hole pattern 22, it is thus true, just as in the case of an embodiment of the device according to the invention described hereinafter, that the second row of holes 14.2 of the hole pattern 22 associated with the first suction-chamber opening 12.1 and the first row of holes 14.1 of the hole pattern 22 associated with the second suction-chamber opening 20.1 extend more-or-less radially with respect to the rotational axis 5' and enclose an angle which is at least the size of the diametric angle alpha.

Figure 3:
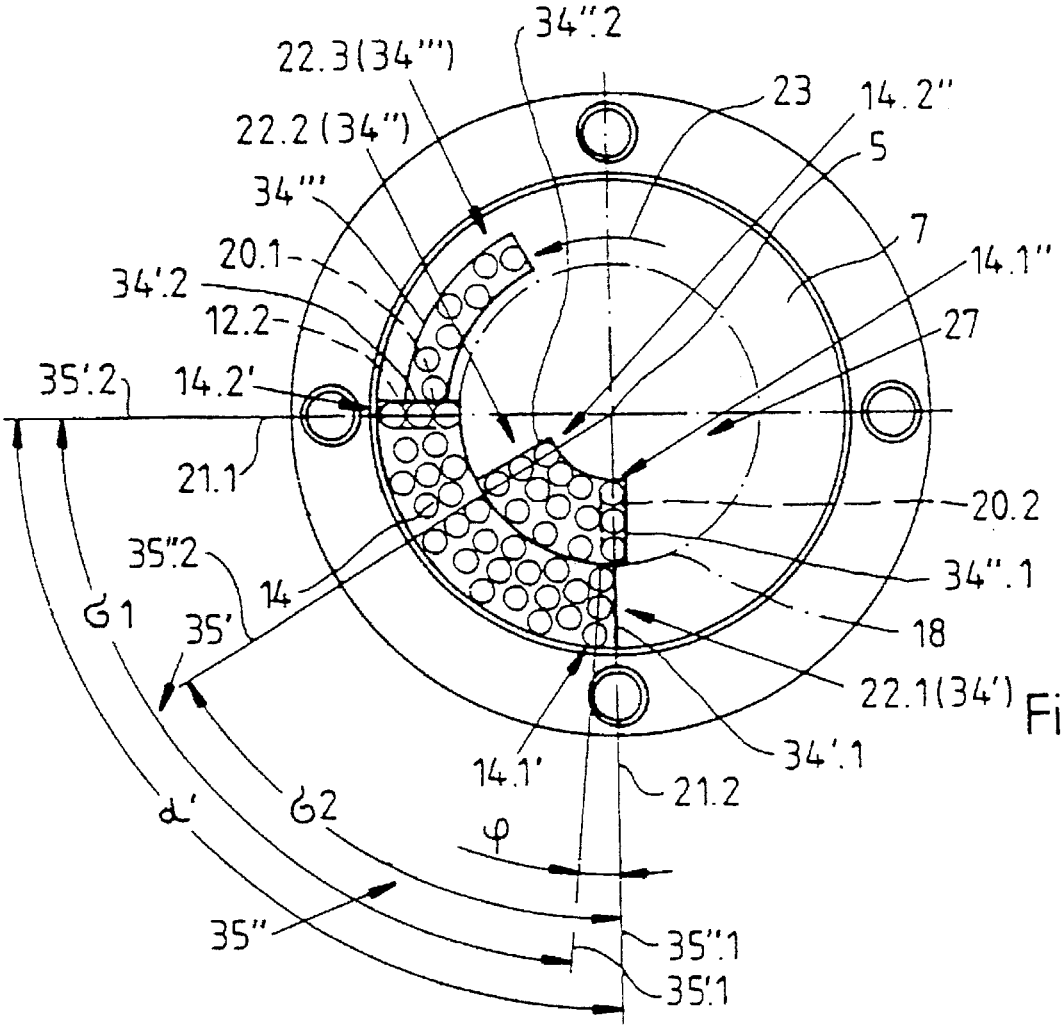
FIG. 3 is a view like that of FIG. 2 of a different embodiment of the sheet-aligning device.

In FIG. 3, which shows a different exemplary embodiment of the device according to the invention, the suction chambers have been omitted in the interest of clarity. Of the suction-chamber arrangement provided in this case, once again only a first suction-chamber opening 12.2 and a second suction-chamber opening 20.2 are indicated. Represented by a phantom or dot-dash line 18 is an imaginary lateral cylindrical surface concentric with the rotational axis 5'. With respect to the imaginary lateral cylindrical surface 18, in the embodiment of FIG. 3, the first suction-chamber opening 12.2 and the second suction-chamber opening 20.2 lie, respectively radially outside and radially inside the lateral cylindrical surface 18. The first suction-chamber opening 12.2 and the second suction-chamber opening 20.2 are associated, respectively, with a first hole pattern 22.1 and a second hole pattern 22.2 with respective envelope curves in the form of a first circular-ring sector 34' and a second circular-ring sector 34", so that the phantom line 18 indicating the aforementioned lateral cylindrical surface represents an inner envelope arc of the first circular-ring sector 34' and an outer envelope arc of the second circular-ring sector 34". The first suction-chamber opening 12.2 extends in the radial direction with respect to the rotational axis 5' from the aforementioned inner envelope arc of the first circular-ring sector 34' to as far as an outer envelope arc thereof, whereas the second suction-chamber opening 20.2 extends in the aforementioned radial direction from an inner envelope arc of the second circular-ring sector 34", to as far as the aforementioned outer envelope arc thereof. Also in this embodiment, therefore, the radial extents of the respective hole patterns 22.1 and 22.2 are matched to those of the associated suction-chamber openings 12.2 and 20.2.

The first and second hole patterns 22.1 and 22.2 are each formed by a part of the suction openings 14. The end of the first circular-ring sector 34' lagging in the rotational direction 23 of the suction plate 7 is adjoined by a third hole pattern 22.3 which is formed by a further part of the suction openings 14, and is discussed in greater detail hereinafter. Consequently, each suction-chamber opening 12.2 and 20.2 is associated with at least one hole pattern 22.1 or 22.2 or 22.3 formed by at least one part of the suction openings.

The first circular-ring sector 34' and the second circular-ring sector 34", are each limited in the circumferential direction, respectively, by a leading first end face 34'.1 and 34".1 and by a lagging second end face 34'.2 and 34".2. Formed along the respective first end face 34'.1 and 34".1 by respective parts of the suction openings 14 is a first row of holes 14.1' and 14.1", and along the respective second end face 34'.2 and 34".2 a second row of holes 14.2' and 14.2".

The hole patterns 22.1 and 22.2, limited respectively by the circular-ring sectors 34' and 34", each extend in the circumferential direction so that the first rows of holes 14.1' and 14.1" lie, respectively, on a first sector-angle arm 35'.1 and 35".1 and the second rows of holes 14.2' and 14.2" lie, respectively, on a second sector-angle arm 35'.2 and 35".2 of an imaginary first and second sector 35' and 35", the respective first sector-angle arm 35'.1 and 35".1 leading (as viewed in the rotational direction of the suction plate 7), the respective second sector angle arm 35'.2 and 35".2 lagging and respective first and second sector-angle arms 35'.1 and 35'.2/35".1 and 35".2 enclosing respective sector angles sigma 1 and sigma 2. The duration of the action of the vacuum, which is present at the suction-chamber openings 20.1 and 20.2, respectively, on respective suction openings 14 of the respective hole pattern 22.1 or 22.2 in the respective sector 35' or 35" is thus directly dependent upon the size of the respective sector angle sigma 1 or sigma 2, while the timing sequence of the action or effect of the aforementioned vacuum on the respective hole pattern 22.1 or 22.2 is directly dependent upon the size of a phase angle phi enclosed between the first sector-angle arms 35'.1 and 35".1, and on the size of the herein aforedefined diametric angle (designated as alpha' in FIG. 3).

The device thus described with reference to the exemplary embodiment of FIG. 3 has, as shown in FIG. 3, a diametric angle alpha' of more-or-less 90°, as well as a phase angle phi of more-or-less zero. The fact that the size of the phase angle phi differs perceptibly from zero in FIG. 3 is merely for the purpose of better illustration. Furthermore, the lagging second sector-angle arm 35'.2 of the first sector 35' and the leading first sector-angle arm 35".1 of the second sector 35" enclose an angle of more-or-less 90°. Moreover, a third connected hole pattern 22.3 is formed by further suction openings 14. The hole pattern 22.3 directly adjoins the second row of holes 14.2' of the first hole pattern 22.1 and has, in turn, an envelope curve which exhibits more-or-less the shape of a third circular-ring sector 34'" concentric with the rotational axis 5'. The radial extent of the third hole pattern 22.3 lies inside that of the first hole pattern 22.1 and its extent in the circumferential direction of the suction plate 7 corresponds more-or-less to that of the second hole pattern 22.2.

In the exemplary embodiment shown in FIG. 3, the suction openings 14, as also in the exemplary embodiment of FIG. 2, are of a uniform diameter which, moreover, corresponds more-or-less to the likewise identical width of the first and second suction-chamber openings 20.1 and 20.2. As a result of the smaller radial extent of the third hole pattern 22.3, as discernible from FIG. 3, the third hole pattern 22.3 consequently has a relative total opening cross section, i.e., relative to a defined rotational angle of the suction plate 7, of the suction openings 14 within the aforementioned rotational angle, which is smaller than a corresponding relative total opening cross section of that part of the suction openings 14 forming the first hole pattern 22.1.

Both in the exemplary embodiment according to FIG. 2 and also in the exemplary embodiment according to FIG. 3, the suction openings 14 situated between the first row of holes 14.1, 14.1', 14.1" and the second row of holes 14.2, 14.2', 14.2" can be used to form rows of holes which extend more-or-less radially with respect to the rotational axis 5' of the suction plate 7.

Figure 4:
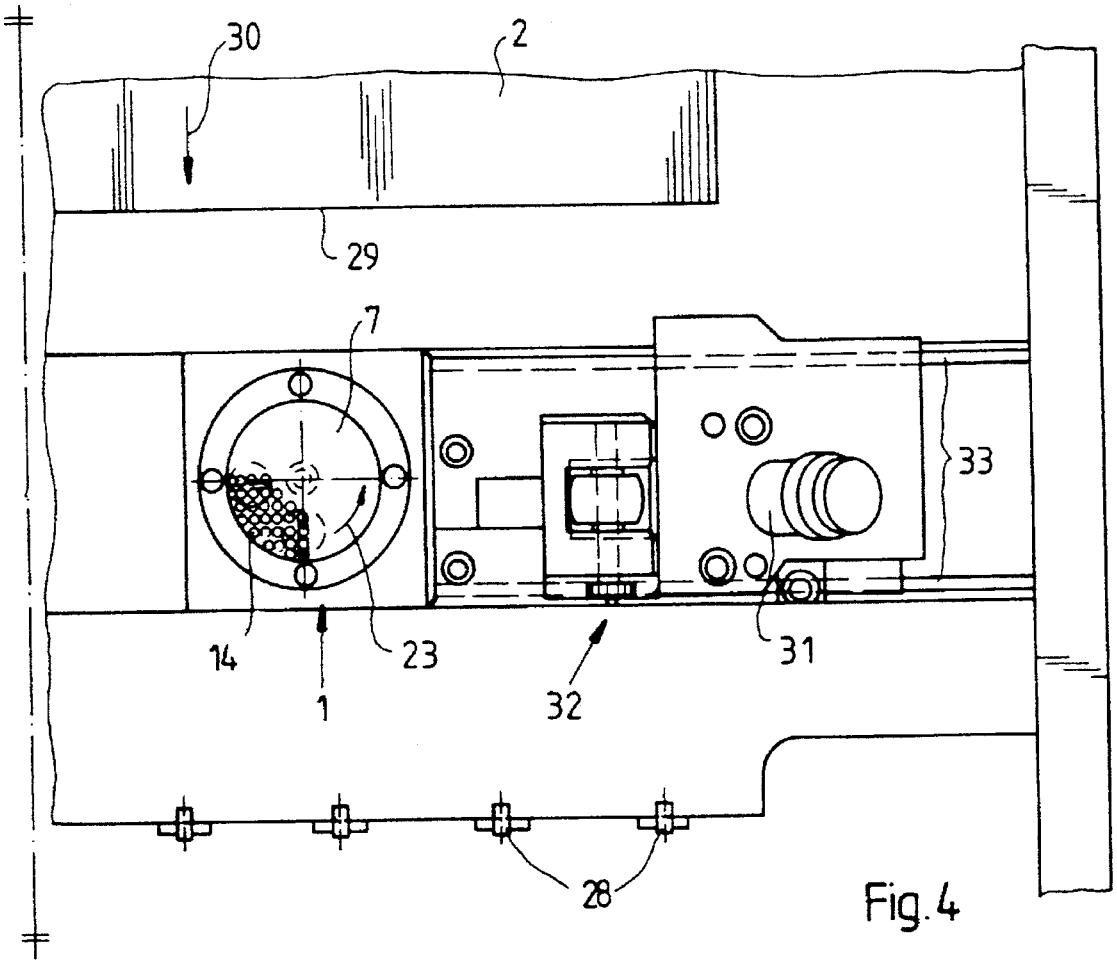
FIG. 4 is a reduced view of FIG. 2 showing in top plan view the device according to the invention forming part of an apparatus of a sheet-fed printing press which serves to align sheets.

FIG. 4 shows a lateral part of a region of a sheet-processing apparatus, otherwise not shown in any greater detail, the sheet-processing apparatus being equipped for practical service with two devices 1, the two devices 1 operating according to the principle outlined in FIG. 2. Due to the fact that FIG. 4 of the drawing is restricted to the aforementioned lateral part, only one of the two devices 1 is represented therein. Front lays 28 are provided, it being intended that the front edge 29 of a sheet 2 transported in the direction of the arrow 30 should come up against the front lays 28. Further provided are side-pull devices, both of which are situated on laterally displaceable slides 32, which are guided in guides 33 and are disposed on respective sides of the sheet-processing apparatus. Due to the limitations of the drawing, once again only one of the pull devices 31 and one of the slides 32 are shown. Each slide 32, associated with one side of the sheet-processing apparatus, is set to a lateral position according to the size of the sheet 2, so that the sheet 2 is able to be accommodated between non-illustrated side lays of the side-pull devices 31. In operation, only one of the two side-pull devices is in use, i.e., the sheet 2 is aligned either at a right-side or a left-side side-pull lay 31 and at the front lays 28. A device 31 is embedded in each slide 32, such a position of the suction-chamber arrangement, such a subjection thereof to vacuum and such a rotation direction of the associated suction plate 7 being provided that, during operation, the sheet 2 to be aligned is subjected to an aligning-force component directed towards the front lays 28 and to an aligning-force component directed towards the side lay on a first slide 32.

Each device 1, together with the respectively associated slide 32, forms a unit which is movable along the guides 33 and is lockable into selective positions.

While a first lateral edge region of the sheet 2 is under the action of the functional units carried by the first slide 32, a second lateral edge region of the sheet 2, opposite the first edge region, is subject to the action of the second device 1 carried by the second slide 32, the second device 1, like the first device, likewise being of a construction according to the principle shown in FIG. 2. Particularly, in the case of a sheet alignment at the non-illustrated side lay of the second slide 32, the suction chamber arrangement and hole pattern of the second device 1, on the one hand, and of the first device 1, on the other hand, are of mirror-image construction, it being necessary to assume an axis of symmetry approximately in a longitudinal center-line of the sheet 2. The mirror-image arrangement is further supplemented by opposite directions of rotation of the two suction plates 7. In the herein-assumed case of the lateral alignment of the sheet 2 at the side lay of the first slide 32, the suction-chamber arrangement of the second device 1 is subjected to vacuum in such a manner that there is only one aligning-force component acting on the sheet 2, that aligning-force component being directed towards the front lays.

The rotational speed of a respective suction plate is matched to the sheet-processing timing of the aforementioned sheet-processing apparatus, with the result that the sequence with which the aligning forces acting upon a particular sheet 2, the aligning forces being directed, on the one hand, towards the front lays 28 and, on the other hand, towards a side lay, conforms with the sheet-processing timing.

I claim:

1. Device for aligning sheets in a sheet-processing machine comprising: a suction plate disposed in a transport surface and being penetrated by suction openings only partially about the suction plate and collectively forming a hole pattern disposed within a sector of the suction plate, the suction plate being rotatingly driven about a rotational axis, a suction-chamber arrangement situated below the suction plate; the suction openings communicating intermittently, at each revolution of the suction plate, with the suction-chamber arrangement situated below the suction plate, said suction-chamber arrangement comprising means for forming two suction-chamber openings disposed on respective diametrics of the suction plate and offset from one another by a defined diametric angle, each of said suction-chamber openings forming a slot extending radially with respect to the rotational axis, at least some of said suction openings being operatively associated with respective ones of said suction-chamber openings such that both said suction-chamber openings communicate suction to said at least some suction openings to align a sheet, said hole pattern having a shape of a circular-ring section concentric with respect to the rotational axis and having a radial extension corresponding to an associated one of said suction-chamber openings.

2. Device according to claim 1, wherein the sheet-processing machine is a sheet-fed printing press.

3. Device for aligning sheets in a sheet-processing machine, wherein the sheets are fed consecutively in a main transport direction along a transport surface, including a suction plate embedded in the transport surface and disposed flush therewith, a suction-chamber arrangement situated below the suction plate; said suction plate being rotatingly drivable with respect to a rotational axis extending perpendicularly to the transport surface and being formed with suction openings only partially about the suction plate and disposed within a sector of the suction plate and communicating intermittently, during operational rotation of the suction plate and in time with the consecutively fed sheets at each revolution of the suction plate, with the suction-chamber arrangement situated below the suction plate, and comprising means for forming a first suction-chamber opening and a second suction-chamber opening, respectively, covered by the suction plate and each forming a slot extending radially with respect to the rotational axis; said first suction-chamber opening being disposed on a first diametric of the suction plate extending transversely with respect to the main transport direction, and the second suction-chamber opening being disposed on a second diametric of the suction plate, said second diametric being offset with respect to said first diametric by a diametric angle in the rotational direction of the suction plate, and said diametric angle being at most 90°; said suction-chamber openings, respectively, being operatively associated with at least one related hole pattern formed of at least one part of the suction openings said first and second suction-chamber openings communicating suction to at least some of said suction openings to align a sheet; the related hole pattern having an envelope curve at least approximately in the form of a circular-ring sector concentric with respect to the rotational axis, said circular-ring sector being formed, on a first end face leading in the rotational direction of the suction plate, with a first row of holes formed by a first part of the suction openings and, on a second end face lagging in the rotational direction of the suction plate, with a second row of holes formed by a second part of the suction openings, the related hole pattern having a radial extent matching that of an associated one of said suction-chamber openings.

4. Device according to claim 3, wherein said at least one related hole pattern includes first and second circular-ring sector-shaped hole patterns each having first and second rows of holes, the second row of holes of the first circular-ring sector-shaped hole pattern is operatively associated with said first suction-chamber opening, and the first row of holes of the second said circular-ring-sector-shaped hole pattern is operatively associated with said second suction-chamber opening extend substantially radially with respect to the rotational axis and enclose an angle having at least the size of said diametric angle.

5. Device according to claim 3, wherein said first suction-chamber opening and said second suction-chamber opening have substantially a like radial extent, and said first and said second suction-chamber openings are operatively associated with the same circular-ring sector-shaped hole pattern.

6. Device according to claim 3, wherein said two suction-chamber openings have respectively different radial extents, one of said two suction-chamber openings, as viewed with respect to an imaginary lateral cylindrical surface concentric with the rotational axis, being disposed radially inside said imaginary lateral cylindrical surface, and the other of said two suction-chamber openings being disposed radially outside said imaginary lateral cylindrical surface.

7. Device according to claim 6, wherein the suction plate comprises a first and a second imaginary sector respectively having a selected sector angle between a first sector-angle arm leading in the rotational direction of the suction plate, and a second sector-angle arm lagging in the rotational direction of the suction plate, a selected phase angle between said first sector-angle arms;

a first row of holes and a second row of holes of a first circular-ring sector-shaped hole pattern operatively associated with said first suction-chamber opening lying, respectively, substantially on said first and said second sector-angle arms of said first sector, and a first row of holes and a second row of holes of a second circular-ring sector-shaped hole pattern operatively associated with said second suction-chamber opening lying, respectively, substantially on said first and said second sector-angle arms of said second sector.

8. Device according to claim 7, wherein said diametric angle has a value of 90°, and said phase angle has a value of substantially zero; said lagging second sector-angle arm of said first sector and said leading first sector-angle arm of said second sector enclosing an angle of substantially 90°, said second row of holes of the first circular-ring sector-shaped hole pattern adjoining a third related hole pattern formed of further suction openings, said third related hole pattern having an envelope curve substantially in the form of a third circular-ring sector concentric with said rotational axis and having a radial extent lying within that of said first hole pattern, said third hole pattern having an extent in the circumferential direction of the suction plate substantially like that of said second hole pattern, a further part of said suction openings forming said third hole pattern having a relative total opening cross section, relative to a defined rotational angle of the suction plate, which is smaller than a corresponding relative total opening cross section of that part of the suction openings forming the first hole pattern.

9. Device according to claim 3, wherein both of said suction-chamber openings are formed on a first and on a second of two suction chambers independently connectable to a vacuum source.

10. In combination with a side-pull device, a device for aligning sheets in a sheet processing machine, the device being operatively associated with the side-pull device, comprising: a suction plate disposed in a transport surface and being penetrated by suction openings only partially about the suction plate and collectively forming a hole pattern disposed within a sector of the suction plate, the suction plate being rotatingly driven about a rotational axis, a suction-chamber arrangement situated below the suction plate; the suction openings communicating intermittently, at each revolution of the suction plate, with the suction-chamber arrangement situated below the suction plate, said suction-chamber arrangement comprising means for forming two suction-chamber openings disposed on respective diametrics of the suction plate and offset from one another by a defined diametric angle, each of said suction-chamber openings forming a slot extending radially with respect to the rotational axis, at least some of said suction openings being operatively associated with respective ones of said suction-chamber openings such that both said suction-chamber openings communicate suction to said at least some suction openings to align a sheet, said hole pattern having a shape of a circular ring section concentric with respect to the rotational axis and having a radial extension corresponding to an associated one of said suction-chamber openings.

* * * * *